United States Patent [19]

Coppola, Jr.

[11] Patent Number: 4,493,175

[45] Date of Patent: Jan. 15, 1985

[54] ROOFING SYSTEM

[75] Inventor: Joseph C. Coppola, Jr., Lincoln Park, N.J.

[73] Assignee: Pantasote Inc., Greenwich, Conn.

[21] Appl. No.: 423,430

[22] Filed: Sep. 24, 1982

[51] Int. Cl.[3] ..... E04D 1/26; E04D 1/28

[52] U.S. Cl. ..... 52/410; 52/540

[58] Field of Search ..... 52/409, 410, 478, 518, 52/519, 520, 543, 521, 748, 540, 515, 592, 539, 535

[56] References Cited

U.S. PATENT DOCUMENTS

| | | | |
|---|---|---|---|
| 632,825 | 9/1899 | Redick | 52/539 |
| 652,150 | 6/1900 | Terpening | 52/539 |
| 3,468,086 | 9/1969 | Warner | 52/748 |
| 4,192,116 | 3/1980 | Kelly | 52/518 |

*Primary Examiner*—James L. Ridgill, Jr.
*Attorney, Agent, or Firm*—Jacobs & Jacobs

[57] ABSTRACT

A roofing system, comprising a roof; a plurality of elongated roofing members on said roof, each said member comprising an elongated, three-ply laminate body portion and integral opposed, first and second longitudinally extending edge portions, said first edge portion comprising a one-ply cover means and a two-ply body means and said second edge portion comprising said three-ply laminate; said three-ply second edge portion of a said member being between said cover means and said two-ply body means of an adjacent said member, and means for fastening a said second edge portion of one member and its associated body means of an adjacent member to said roof.

8 Claims, 6 Drawing Figures

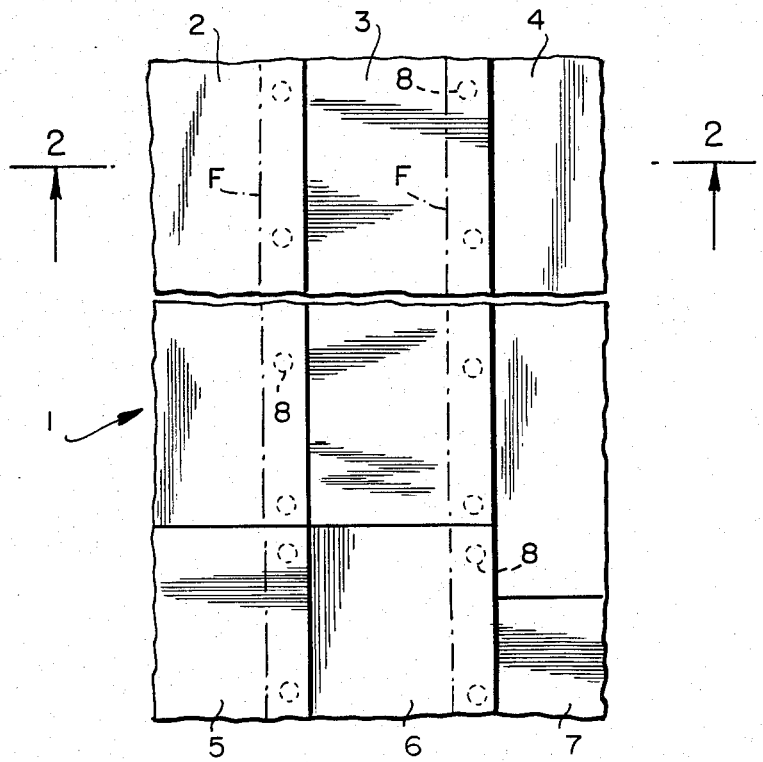
FIG. 1
FIG. 2
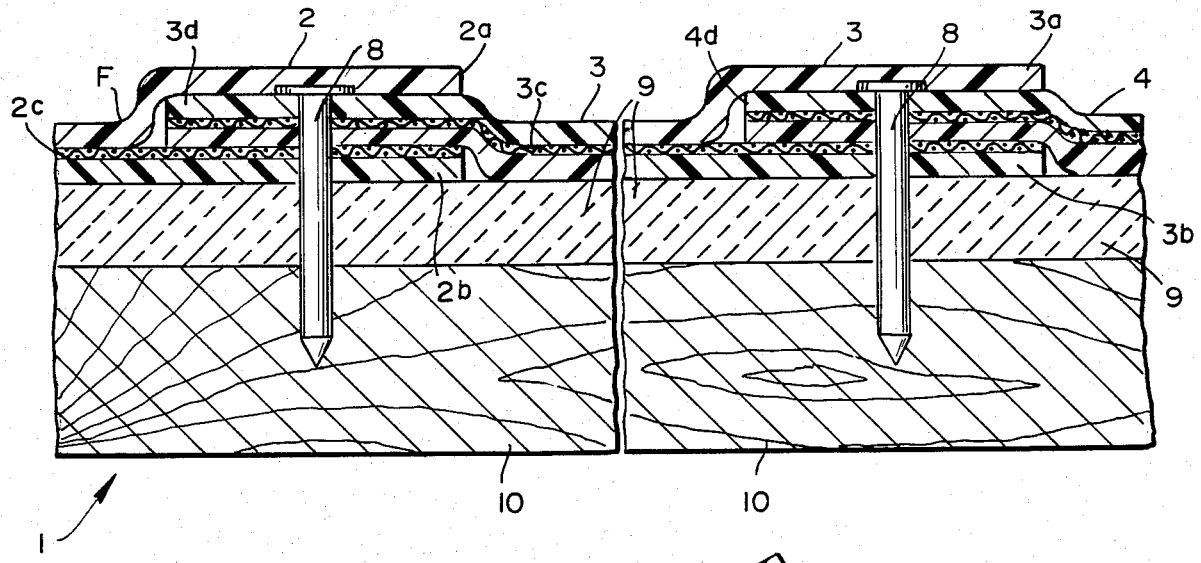
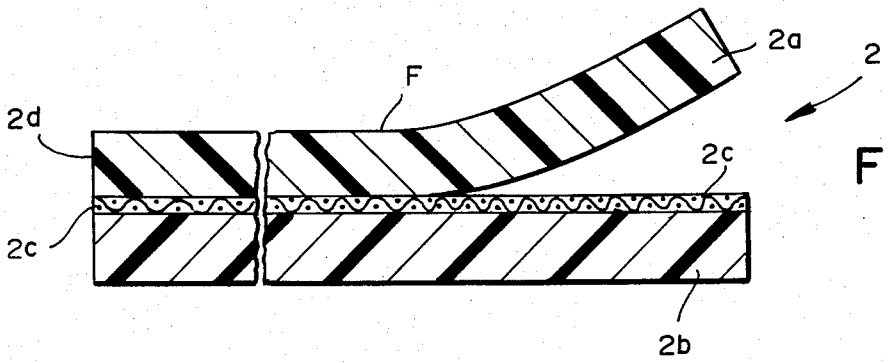
FIG. 3

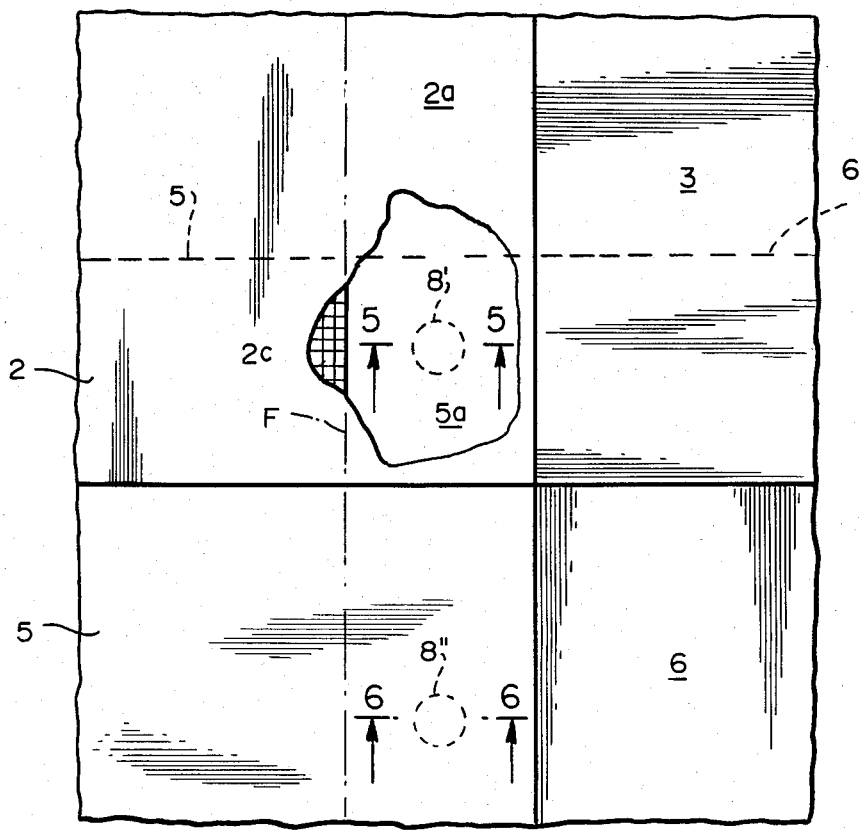
FIG. 4
FIG. 6
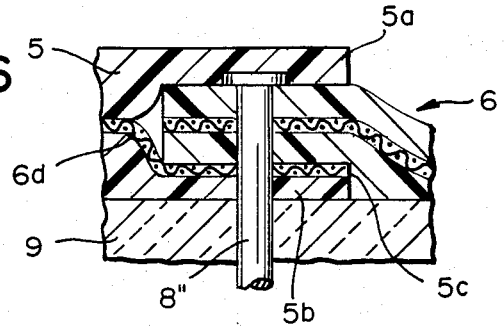
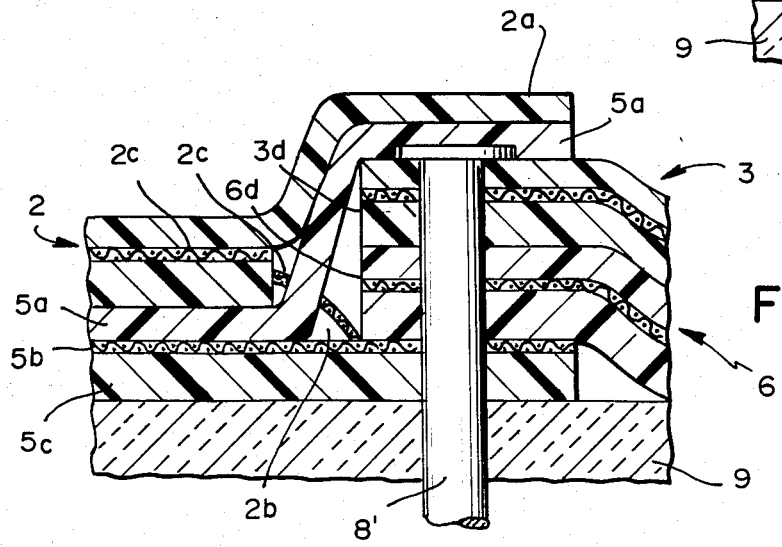
FIG. 5

ROOFING SYSTEM

The present invention relates to a roofing system employing a roofing membrane secured to the roof deck.

Roofing systems employing roofing membranes are known in the art. In such systems, the roofing membrane is supplied in the form of long strips. An edge of the first strip of the roofing membrane is secured to the flashing at the outermost edge or flashing means of the roof, by various methods, including a suitable adhesive, such as tetrahydrofuran, and the free edge is secured to the top of the roof by means of suitable fasteners that penetrate through the membrane into the roof deck. The next strip is laid parallel to the first strip by placing one edge of the second strip over the fasteners in the first strip and sealing the two edges together by means of an adhesive or by heat welding. The free edge of the second strip is then secured to the roof deck by means of fasteners and the process is repeated until the entire roof is covered with parallel strips of roofing membrane. Generally, the roofing membrane comprises three-plies, namely, outer plies of a polymeric material heat-bonded to each other and to an inner ply of a fabric, plastic or glass scrim.

In conventional roofing systems, only one edge of each strip of membrane is secured to the roof by means of fasteners, and to insure that the roofing system will withstand wind forces that are encountered during use, a large number of fasteners per lineal foot are employed. The operation by which the strips of membrane are secured to the roof by means of the fasteners is labor intensive. Hence, the cost of the fasteners themselves and the labor costs of installing the fasteners represent a significant portion of the total cost of the roofing system.

The present invention now provides an improved roofing system that is less labor intensive and less costly. In the system of the present invention, a three-ply roofing membrane is employed, preferably comprising outer plies of a polymeric material and an inner reinforcement. One edge of each three-ply membrane terminates in a cover flap consisting of one ply of material and a two-ply base portion consisting of the two other plies of material. The single-ply cover flap and the two-ply base portion are integral with the remainder of the roofing membrane. The polymeric material may be an elastomer or a non-elastomeric plastic.

A roof constructed according to the invention, comprises parallel strips of the roofing membrane according to the invention, with the three-ply edge of one strip being inserted between the cover flap and base portion of the adjacent strip, in tongue-and-groove fashion, and fasteners secure the strips to the roof deck by penetrating through the edge of one strip having three integral plies and through the base portion of the adjacent strip and thence into the roof deck.

The present invention is illustrated in terms of a preferred embodiment in the accompanying drawings, in which:

FIG. 1 is a plan view of a plurality of roofing membranes secured together to form the roofing system according to the invention;

FIG. 2 is an enlarged view, in section, taken along lines 2—2 of FIG. 1;

FIG. 3 is a greatly enlarged view, in section, of a roofing membrane according to the invention;

FIG. 4 is a plan view, with parts broken away, illustrating how roofing membranes are joined together end-to-end;

FIG. 5 is an enlarged view, in section, taken along lines 5—5 in FIG. 4; and FIG. 6 is an enlarged view, in section, taken along lines 6—6 in FIG. 4.

As can be seen in FIG. 1, the roofing system according to the invention, comprises a plurality of roofing membranes 2–7 joined together along their longitudinal extending edges; it will be understood that sufficient strips of membranes are employed so that the entire extent to the roof is covered. Strips 2–7 are secured together by fasteners 8 in a manner to be described in detail below. Each of strips 2–7 comprises outer plies of polymeric material, such as PVC, chlorinated polyethylene or Hypalon, and an innermost ply of a reinforcing scrim, such as a 10×10 scrim formed of 1,000 denier, polyester fibre. Strips 2–7 are provided in the form of large rolls, and the ends of adjacent strips are often offset, as in the case of strips 3 and 4.

Referring to FIG. 2, it can be seen that each fastener 8 secures two membrane strips to the roof, such as strips 2 and 3 and 4 and 3. Fasteners 8 pass through the strips 2, 3 and 4, 3 and through layer 9 of insulation and thence into roof deck 10. Each of the membrane strips 2–7 is formed in the same manner and strip 2 is shown in detail in FIG. 3. Roof deck 10 is shown as being made of wood, but the invention is operable with any roof deck, such as steel or concrete or any other suitable material.

Thus, the strip 2 has outer plies **2*a* and 2*b* of polymeric or elastomeric material bonded to each other and to the reinforcing scrim 2*c*. At one edge 2*d* of the strip 2, all three plies are bonded together, while at the opposite edge of the strip 2, the top ply 2*a* is separated from the other plies 2*b* and 2*c*. Plies 2*b* and 2*c* may be bonded to each other to form a base portion, as shown, or scrim 2*c* may loosely overlie the base 2*b*. Top ply 2*a* functions as a cover flap, which can be folded along fold line F. Strip 2** may suitably be from 30–60 mils thick, but the thickness will be determined by such factors as the stresses encountered, the required durability etc.

With reference to FIG. 2, the edge **3*d* of stip 3 lies between the cover flap 2*a* and the base portion 2*b*, 2*c* of strip 2, and fastener 8 thus penetrates the three plies of edge 3*d* of strip 3 and the two plies of the base portion 2*b*, 2*c* of strip 2. Cover flap 2*a* is secured to the top of edge 3*d* by means of an adhesive or heat-bonding in a conventional manner, to create a water-tight roofing system. The edge of strip 3 opposite from edge 3*d* likewise terminates in a cover flap 3*a* and a two ply base portion 3*b*, 3*c*, and fastener 8 penetrates the three plies of edge 4*d* and the two plies of base portion 3*b*, 3*c* before entering the insulation 9 and the roof deck 10**.

Additional strips of roofing membrane are laid edge-to-edge as described above so that the entire width of the roof is covered.

The ends of the strips are joined together as shown in FIGS. 4–6. Here, strips 2, 3, 5 and 6 are shown for simplicity, it being understood that the same pattern of attachment is followed for the other strips. Strips 2 and 3 overlie strips 5 and 6, respectively.

As shown in FIG. 4, an end of strip 5 is placed under the end of strip 2 after the lower, right-hand corner of the strip 2 is first removed by cutting the base portion **2*b*, 2*c* along fold line F to the point where the end of strip 5 will be located, and then cutting base portion 2*b*, 2*c* perpendicular to fold line F to the edge of strip 2**.

Cover flaps 2*a* and 5*a* are raised as a unit, and edges 3*d* and 6*d* (FIG. 5) of strips 3 and 6 are placed between cover flap 5*a* and base portion 5*b*, 5*c* and the fastener 8' will thus pentrate the three plies of strips 3 and 6 and the two plies of base portion 5*b*, 5*c*. Cover flaps 2*a* and 5*a* will overlie fastener 8' and these are secured to each other and to strip 3 as described above. Strip 3 overlaps strip 6 in the same manner as strip 2 overlaps strip 5. Fastener 8" (FIG. 6) penetrates the three plies of strip 6 and the two plies of the base portion 5*b*, 5*c* and is covered by cover flap 5*a*.

Through the use of the present invention, both edges of each strip of roofing membrane are securely fastened to the roof. Further, the fasteners pass through five plies of membrane, rather than three plies as in the prior art systems. Hence, the number of fasteners per lineal foot of membrane may be reduced for a given set of forces acting on the membrane as compared to the prior art, thus reducing the cost of fasteners and the cost of labor to install them.

What is claimed:

1. A roofing system, comprising a roof; a plurality of prefabricated elongated roofing members on said roof, each said prefabricated member comprising an elongated strip having a three-ply laminate body portion comprising outer plies of a polymeric material and an inner ply of a reinforcing material and integral opposed, first and second longitudinally extending edge portions, said first edge portion comprising a one-ply cover means comprising one of said outer plies of said polymeric material and a two-ply body means comprising the other of said outer plies of said polymeric material laminated to said reinforcing material, and said second edge portion comprising said three-ply laminate; said three-ply second edge portion of a said member being between said cover means and said two-ply body means of an adjacent said member, and means for fastening a said second edge portion of one member and its associated body means of an adjacent member to said roof.

2. The roofing system according to claim 1, wherein said fastening means are inserted through said three-ply second edge portion and said associated two-ply body means and into said roof.

3. The roofing system according to claim 1, wherein said cover means overlies and is secured to a said second edge portion inserted between said cover means and its associated said body means, said cover means also covering said fastening means.

4. The roofing system according to claim 1, wherein said reinforcing material is a fabric scrim.

5. The roofing system according to claim 4, wherein said scrim is a polyester scrim.

6. A roofing member, which comprises a prefabricated elongated strip having a three-ply laminate body portion comprising outer plies of a polymeric material and an inner ply of a reinforcing material and integral opposed, first and second longitudinally extending edge portions, said first edge portion comprising a one-ply cover means comprising one of said outer plies of said polymeric material and a two-ply body means comprising the other of said outer plies of said polymeric material laminated to said reinforcing material, and said second edge portion comprising said three-ply laminate.

7. The roofing member according to claim 6, wherein said reinforcing material is a fabric scrim.

8. The roofing member according to claim 7, wherein said scrim is a polyester scrim.

* * * * *